United States Patent [19]

Nudinger et al.

[11] 3,971,524

[45] July 27, 1976

[54] DEVICE FOR CONNECTING AN EXPIRING FIRST WEB OF A WEB-SHAPED MATERIAL WITH THE BEGINNING OF A SECOND WEB OF A WEB SHAPED MATERIAL

[75] Inventors: Günter Nudinger, Kempten; Heinrich Collin, Munich; Hans Moosburger, Weiherhammer, all of Germany

[73] Assignee: Bayerische Berg-, Hutten- und Salzwerke AG, Munich, Germany

[22] Filed: Oct. 5, 1973

[21] Appl. No.: 404,029

Related U.S. Application Data

[62] Division of Ser. No. 263,567, June 16, 1972, Pat. No. 3,837,954.

[30] Foreign Application Priority Data

June 16, 1971 Germany ..... 2129903

[52] U.S. Cl. ..... 242/58.4; 156/504; 242/75

[51] Int. Cl.[2] ..... B65H 19/10

[58] Field of Search ..... 242/58.1, 58.2, 58.3, 242/58.4, 58.5, 75.3, 75, 75.4–75.47, 75.5, 156, 156.2, 147 R; 156/502, 504, 507

[56] References Cited

UNITED STATES PATENTS

| | | | |
|---|---|---|---|
| 1,724,225 | 8/1929 | Scott | 242/58.4 |
| 3,753,833 | 8/1973 | Bassett et al. | 242/58.4 |

FOREIGN PATENTS OR APPLICATIONS

| | | | |
|---|---|---|---|
| 230,878 | 10/1960 | Australia | 242/75.3 |

*Primary Examiner*—Stanley N. Gilreath
*Assistant Examiner*—John M. Jillions
*Attorney, Agent, or Firm*—Woodhams, Blanchard and Flynn

[57] ABSTRACT

An apparatus for connecting a first web of a web-shaped material unwinding from a first roll with the beginning of a second web of a web-shaped material unwinding from a second roll. The beginning of the second web is cemented to a transfer element by means of an adhesive area applied thereto. The transfer element is then moved toward the first web and/or the first web is moved toward the transfer element and the transfer element is accelerated to a speed corresponding to the speed of the expiring first web while a loose initial region of the second web is concurrently pulled tighter and the beginning of the second web is then cemented to the first web by means of another adhesive area applied to the beginning of the second web facing the side averse the first adhesive area and is pulled away from the transfer element. The acceleration of the second roll is carried out by the tension exerted by the first web after the beginning of the second web has been cemented to the expiring first web, and tension overloads and sudden loads exerted on the webs and the points of cementation between the web during initial acceleration being prevented by conducting the respective web over a force storage means which yields under increased tension on the path of the web to further processing stations.

20 Claims, 10 Drawing Figures

DEVICE FOR CONNECTING AN EXPIRING FIRST WEB OF A WEB-SHAPED MATERIAL WITH THE BEGINNING OF A SECOND WEB OF A WEB SHAPED MATERIAL

This is a division of application Ser. No. 263,567 filed June 16, 1972, now U.S. Pat. No. 3,837,954.

This invention relates to an apparatus for connecting a first web of a web-shaped material unwinding from a first roll with the beginning of a second web of a web-shaped material unwinding from a second roll, in which the beginning of the second web is cemented to the unwinding first web and the expiring first web is then cut off behind the point of cementation.

BACKGROUND OF THE INVENTION

Processes and devices of the type explained above are already known in which both the first as well as the second web is wound up onto a roll in each case and unwinds from this roll again. The beginning of the second web is connected with the expiring first web in these known processes and devices by pressing the expiring old web onto the roll of the new web or by pressing the roll of the new web onto the old web. In so doing, the old web then comes into contact with an adhesive strip attached to the circumference of the roll of the new web at the beginning of the new web and then pulls the new web along with it. These known processes and devices, however, have several drawbacks. On the one hand, expensive pivotal bases are necessary in order to be able to move the new roll to the old web. In addition, the speed of the new web roll must be coincided exactly with the speed of the old web before the beginning of the new web is cemented to the old web. For this purpose, it is necessary in most of the devices and processes to reduce the speed of the old web while the new is being connected or to accelerate the new web roll to the necessary speed by means of special driving means. In the case of the known processes and devices, it is not possible either to unwind the new web arbitrarily from its roll such that either the web surface facing the interior of the roll comes to lie on top or the web surface facing the exterior of the roll. Only the web surface facing the exterior of the roll can be connected with the old web. Seen in their entirety, the known processes and devices are unreliable and uneconomical in operation and can only be employed to a limited extent.

SUMMARY OF THE INVENTION

The invention is based on the task of providing an apparatus of the type hereinbefore cited and a device for carrying out this process, which are simple and economical and ensure rapid and reliable connection of a second web to a first web at an arbitrary web speed irrespective of the type of base employed to support the webs and permits optional connecting of the web upper or lower side of the second web with the first web.

This task is solved in accordance with the invention in that the beginning of the second web is cemented to a transfer element by means of an adhesive area applied thereto, that the transfer element is then moved toward the first web and/or the first web is moved toward the transfer element and the transfer element is accelerated to a speed corresponding to the speed of the expiring first web while a loose initial region of the second web is concurrently pulled tighter and the beginning of the second web is then cemented to the first web by means of another adhesive area applied to the beginning of the second web facing the side averse the first adhesive area and is pulled away from the transfer element, the acceleration of the second roll being carried out by the tension exerted by the first web after the beginning of the second web has been cemented to the expiring first web, and tension overloads and sudden loads exerted on the webs and the points of cementation between the web during initial acceleration being prevented by conducting the respective web over a force storage means which yields under increased tension on the path of the web to further processing stations.

The apparatus in accordance with the invention has substantial advantages. The beginning of the new web is initially applied to transfer element. This can be done while the old web is unwinding at an undiminished speed and the transfer element is standing still. The transfer element, which should be constructed such that it has a low mass and low weight, can then be moved toward the old web or the old web can be moved to the transfer element and the transfer element can then be accelerated to the speed of the old web either by bringing it into contact with the old web or by means of its own driving system. Only a low drive output is necessary due to the low mass of the transfer element. When the speeds of the old web and the transfer element coincide, the beginning of the new web can then be connected with the old web, for example, by means of the adhesive strip or an adhesive area of an adhesive coating on both sides at the beginning of the web. Hence, unlike the previously known processes, it is not necessary in the case of the process in accordance with the invention to move the entire heavy web roll with the new web toward the old web or, vice-versa, to move the old web to the roll and to accelerate the entire roll to the speed of the old web before the beginning of the new web has been connected to the old web. Further the invention also makes it possible to connect the new web with the old web as desired such that either the upper side or the underside of the new web is connected with the old web. In so doing, it is only necessary to cement the beginning of the new web with the corresponding side on the top onto the transfer element before this is brought into contact with the old web. In addition the invention permits the beginning of the new web to be affixed to the old web without having to reduce the speed of the old web. The connection of the new web can also take place at very high web speeds of the old web.

Furthermore, the apparatus in accordance with the invention is particularly favorable in that the acceleration of the roll of the second web after the beginning of the second web has been cemented to the unwinding first web can also take place by means of the tension exerted by the first web and that tension overloads and sudden loads in the webs and the points of cementation between the webs, which become apparent during the initial acceleration stage, are prevented by conducting the respective web over a storage means which yields under increased tension loads on its path to further processing stations. Such a storage means makes it possible to gradually accelerate the roll of the second web under the tension of the web without causing the tension in the web to become so great that the web will tear and without causing sudden jerky loads. For this purpose, the web can be conducted, for example, in a long loop which is spring-biased in the storage means so that the loop can be shortened against the action of the spring during an increase in the tension in the web.

DETAILED DESCRIPTION OF THE DRAWINGS

Figure 1:
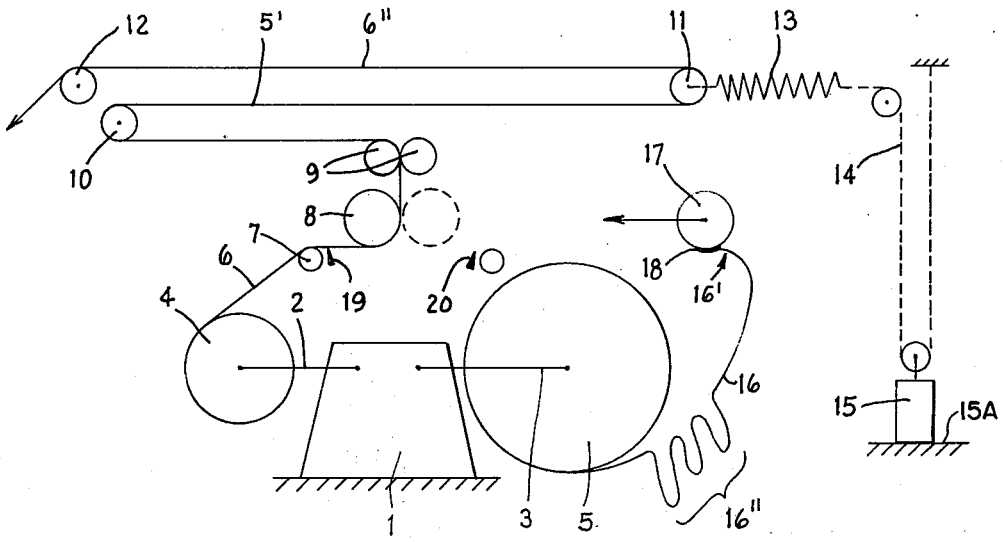
Figure 2:
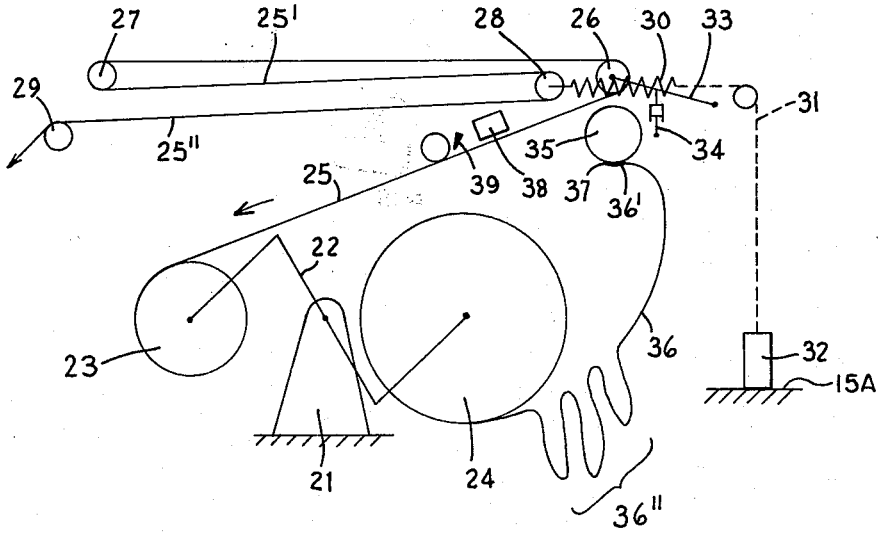
Figure 3:
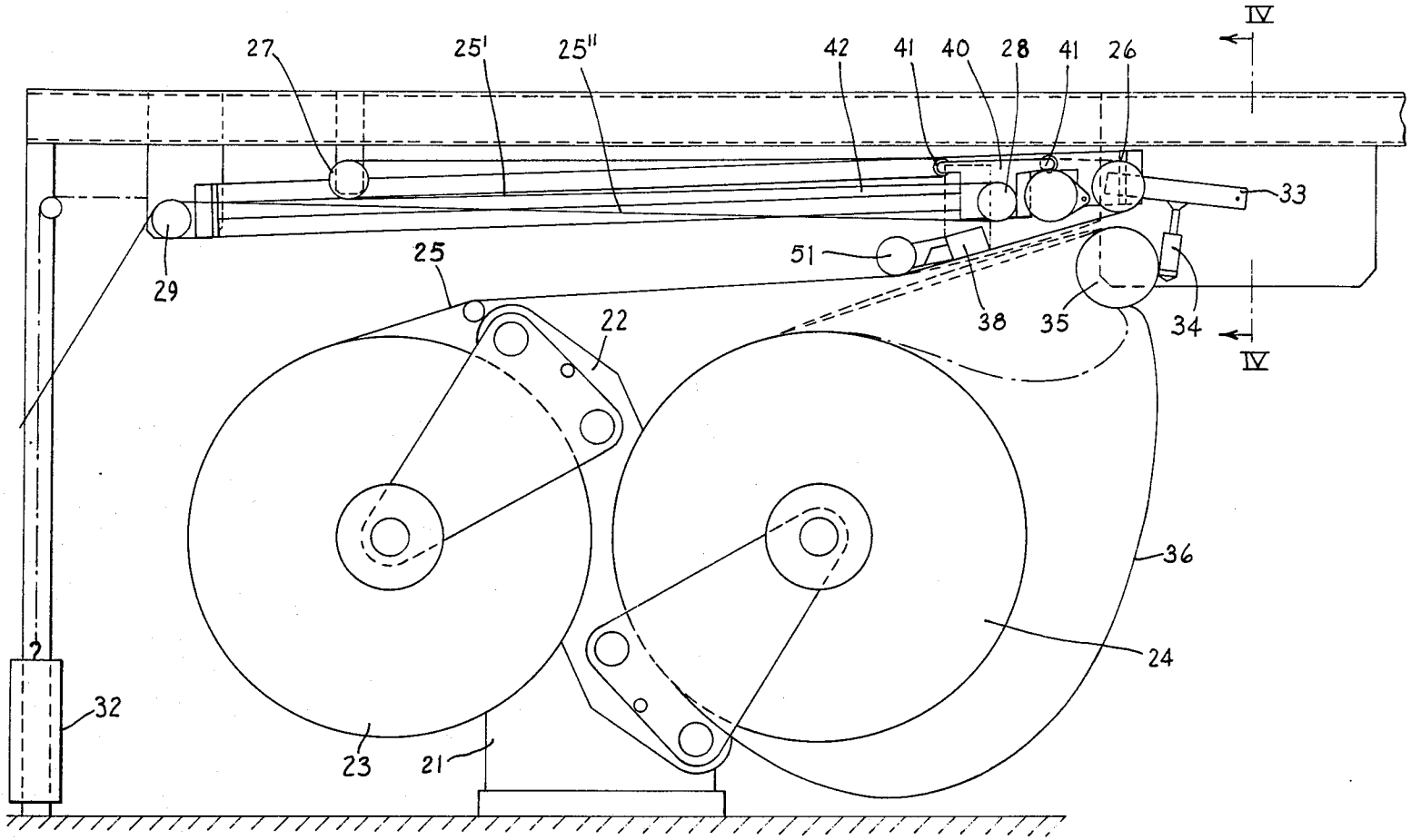
Figure 4:
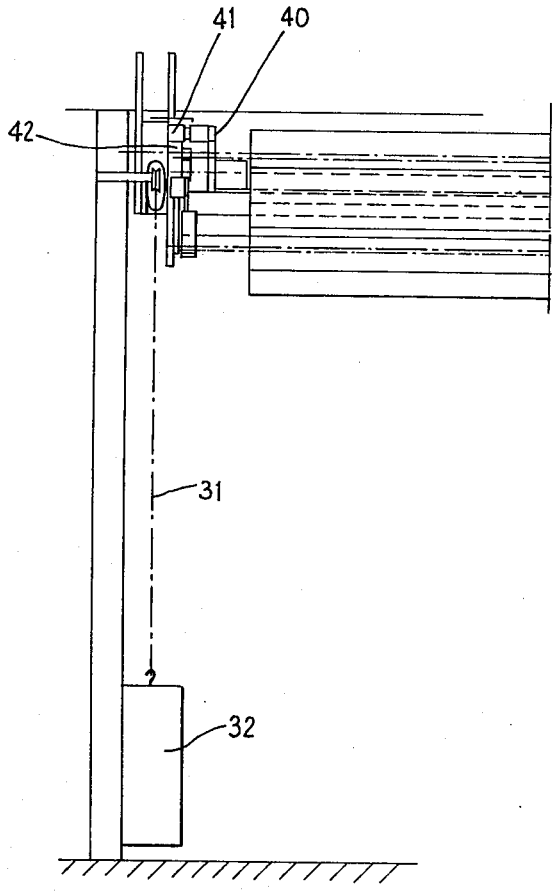
Figure 5:
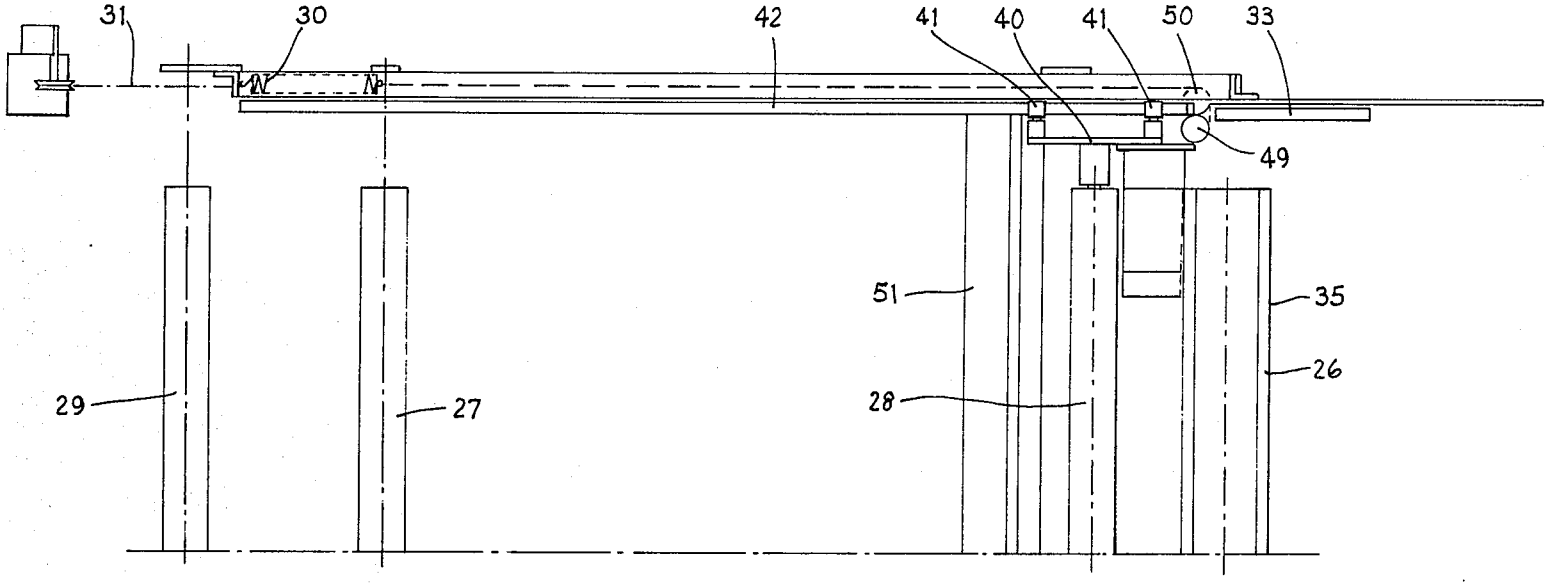
Figure 6:
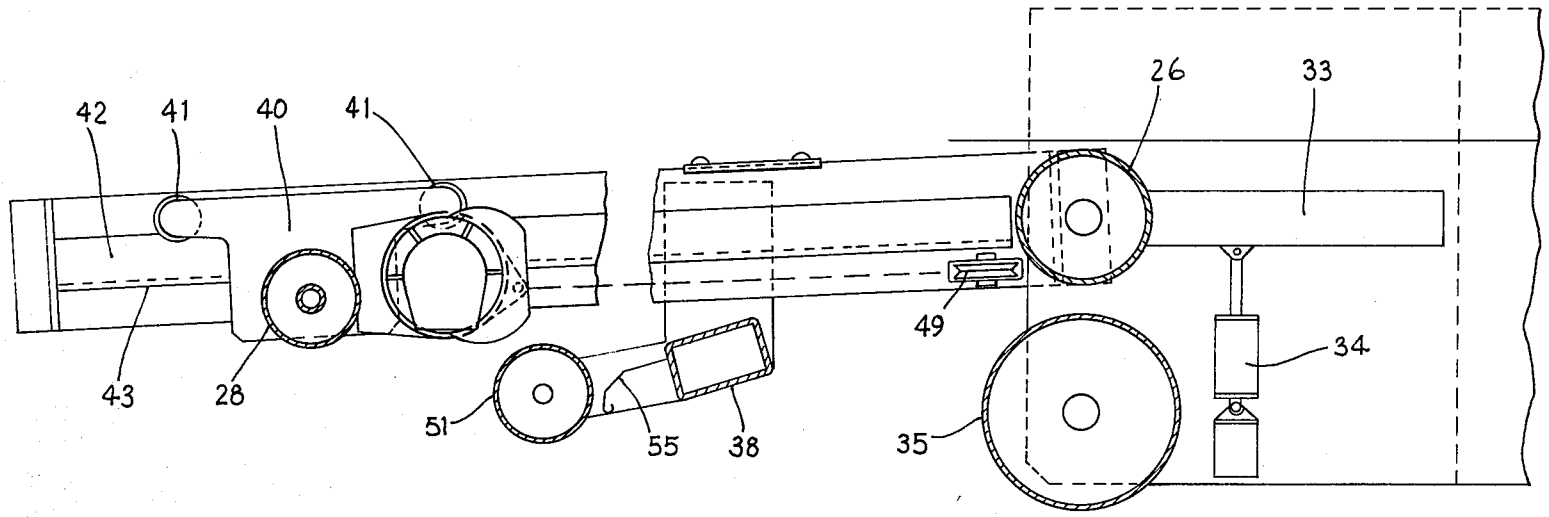
Figure 7:
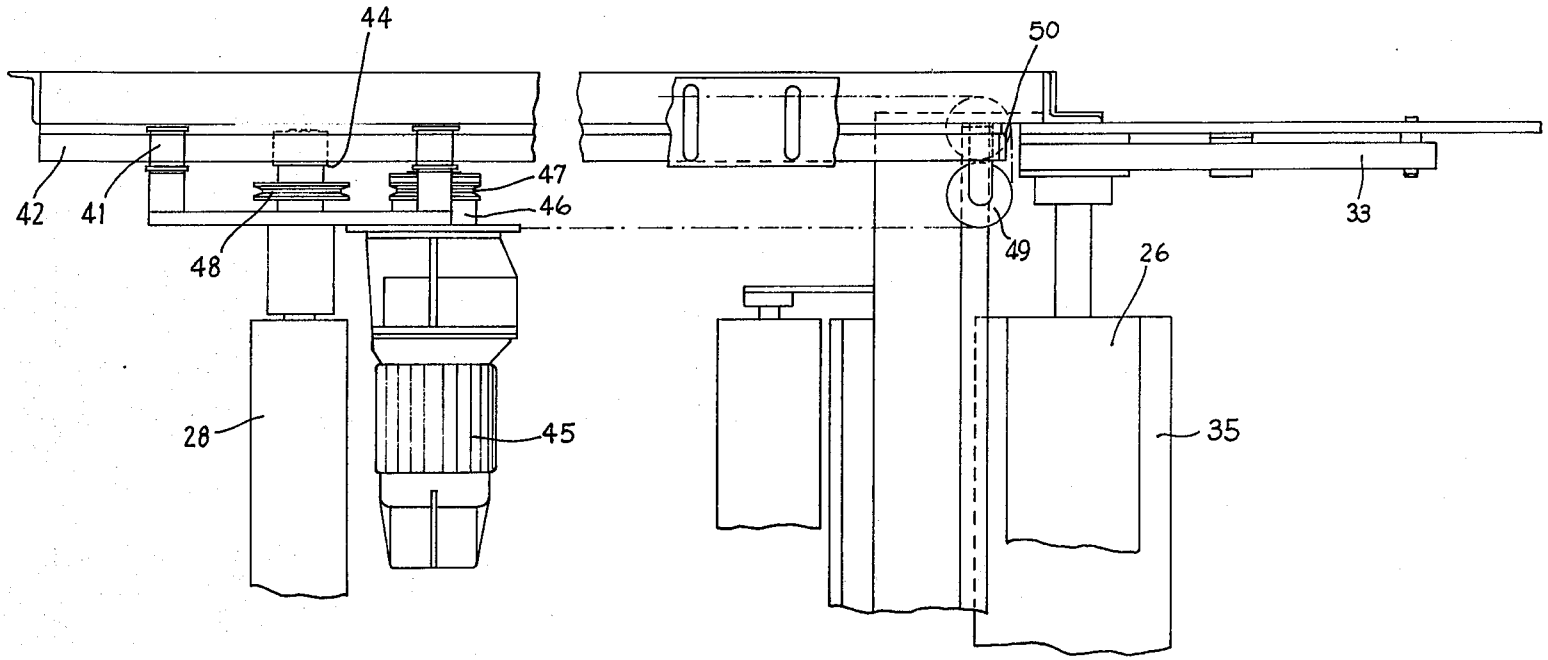
Figure 8:
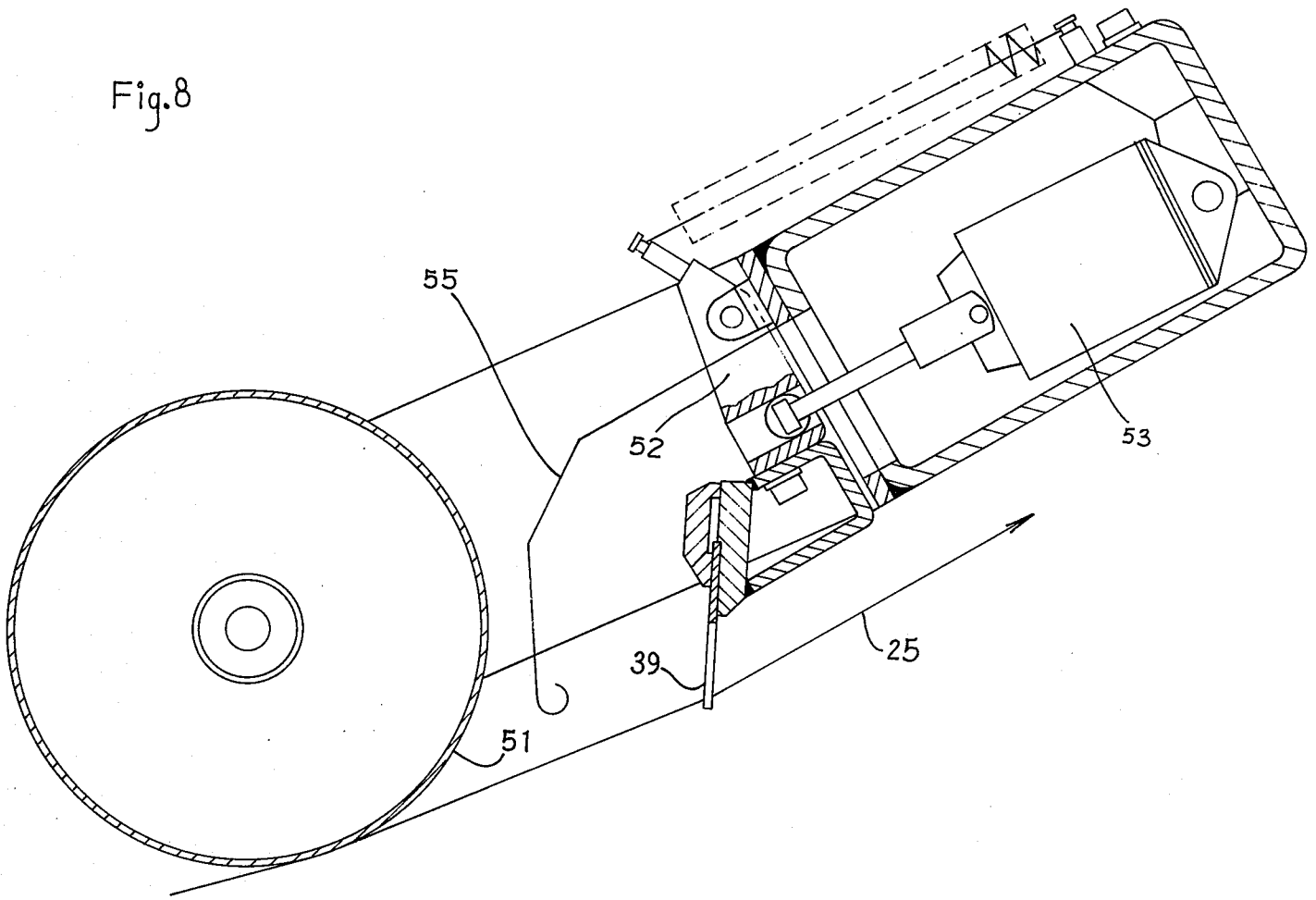
Figure 9:
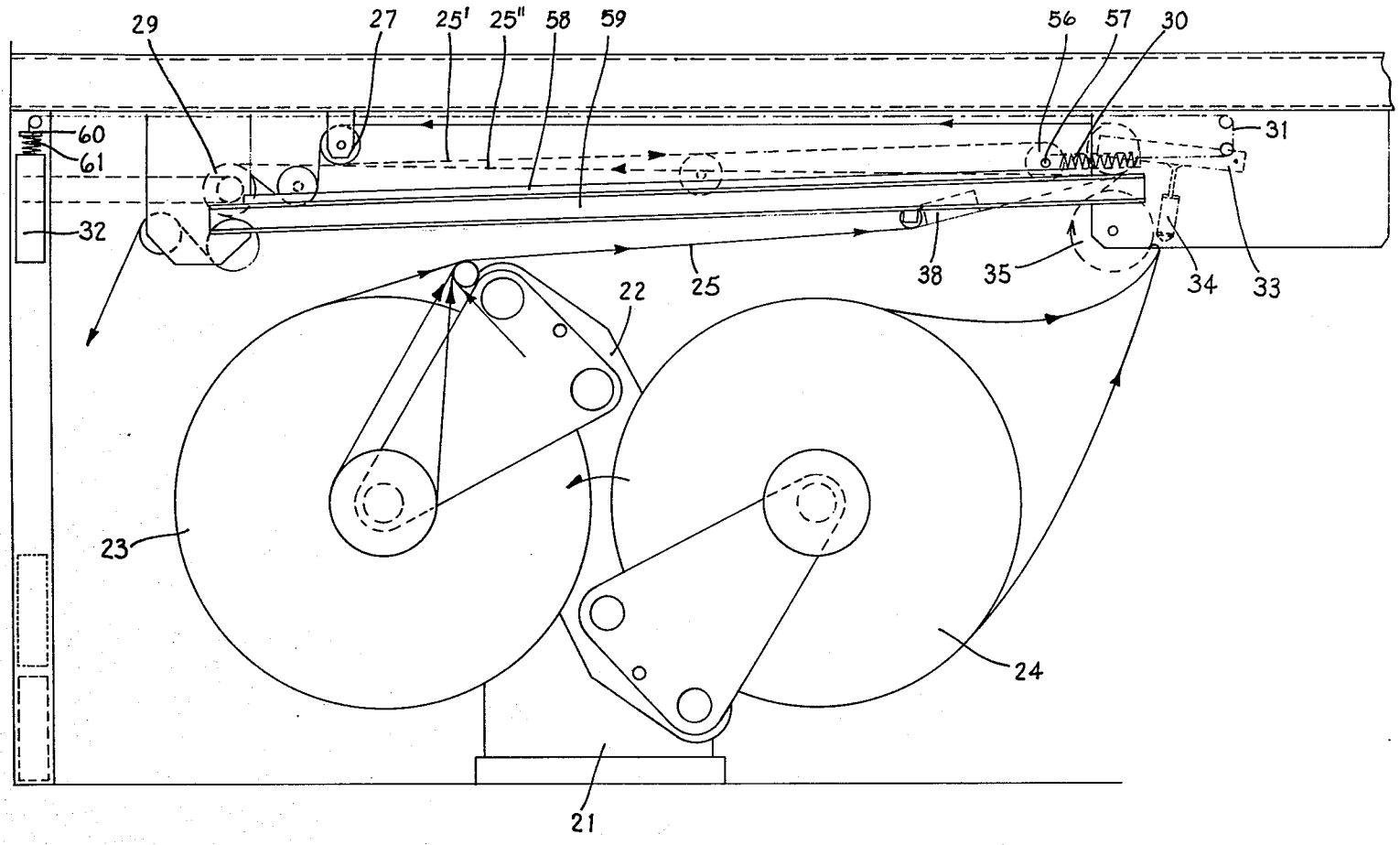
Figure 10:
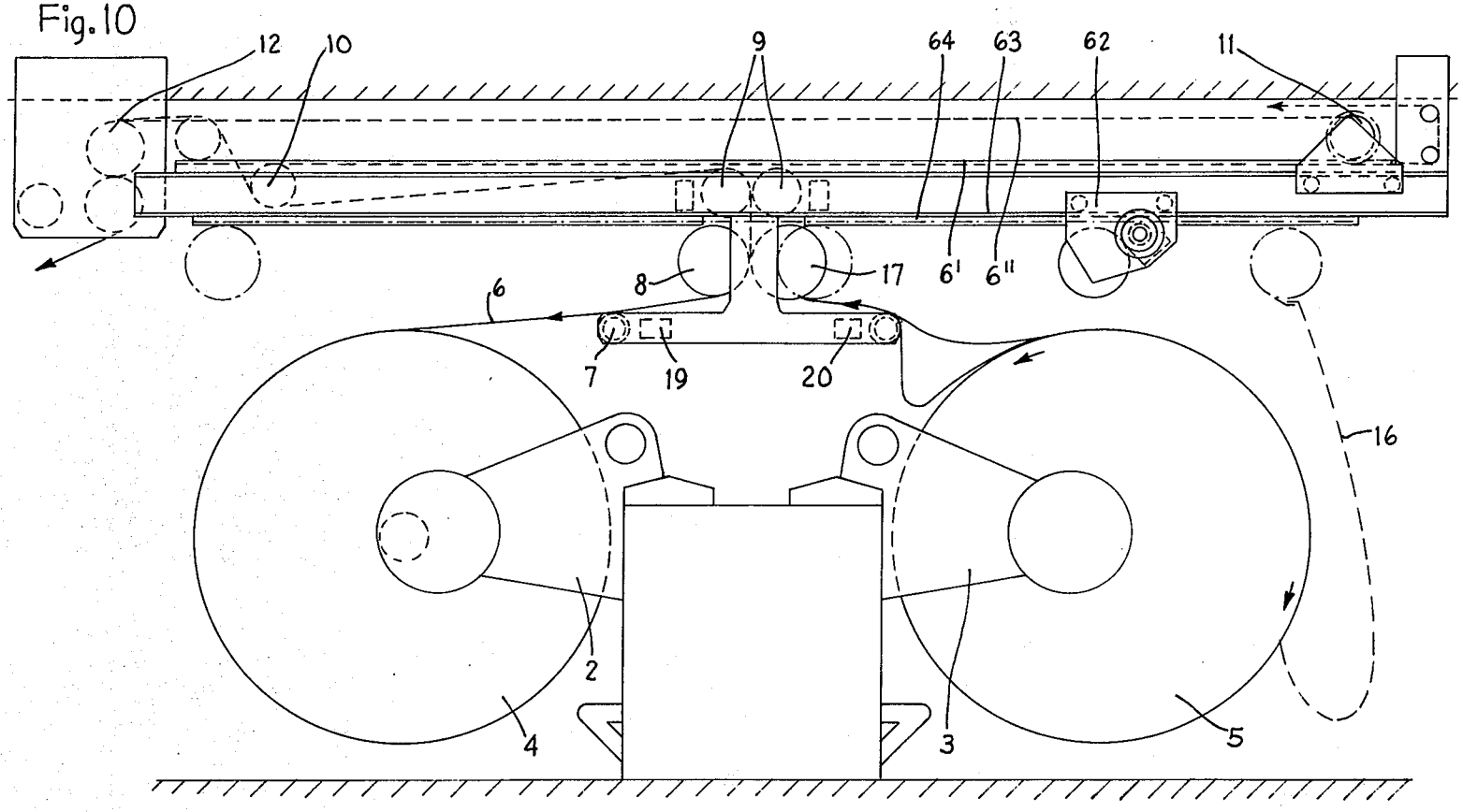

Further features and advantages of the invention will now be more fully described, by way of example, with reference to the accompanying drawing, in which:

FIG. 1 is a schematic elevation of a device embodying the invention and corresponding to a first embodiment, FIG. 2 is a schematic elevation of a second embodiment of the invention, FIG. 3 is a side elevation of a third embodiment of the invention in side elevational view, FIG. 4 is a sectional elevation through the device in accordance with FIG. 3 corresponding to the line IV—IV in FIG. 3, FIG. 5 is a plan view of the device according to FIG. 3, FIG. 6 is a detailed section of the device in accordance with FIG. 3 in side elevation on an enlarged scale, FIG. 7 is a plan view of the detail in accordance with FIG. 6, FIG. 8 is a view of a cutting device of the device in accordance with FIG. 3, FIG. 9 is a side elevation of a fourth embodiment of the invention, FIG. 10 side elevation of a fifth device for carrying out the said process.

DETAILED DESCRIPTION

A first embodiment of a device for carrying out the invention is schematically illustrated in FIG. 1. Two support arms 2 and 3 which can be pivoted and locked in position independently of the other are mounted on a frame 1. Each of these support arms 2 and 3 has a shaft thereon which supports a roll 4 or 5 of wound-up web material at the other end of said arms. In the embodiment which is illustrated in the drawing, these rolls are rolls of paper. A first web 6 is unwound from the roll 4 and proceeds over a guide roller 7 to a drum 8 and then between a pair of guide rollers 9 to a further guide roller 10 which is journaled in a stationary position. The strand 6′ of the web 6 is then transported to a guide roller 11, is reversed 180° and proceeds to the next guide roller 12 as strand 6″ and then to further processing means not shown in the drawing.

The guide roller 11 is mounted on a carriage which is not shown in FIG. 1 for reasons of clarity. This carriage is movably conducted on guide rails (not shown) in the direction of the strands 6′ and 6″ of web 6. Two parallel toothed racks extend along the guide rails which are not shown. A pinion engages each of these toothed racks. The pinions are driven by a motor, which is mounted on the support mounting (not shown), and via a freewheel clutch. This freewheel clutch is designed such that it is disengaged from the motor if the guide roller 11 moves toward the guide rollers 10 and 12 due to the effect of the web strands 6′ and 6″. The end of a tension spring 13 is secured to the guide roller 11 or to the carriage supporting the guide roller. The other end of the spring is connected with a traction wire 14. This traction wire 14 is looped downwardly and is secured to an anchorage at the other end. A weight 15 is hung in the loop of the traction wire 14. The slidable guide roller 11, the spring 13, the traction wire 14 and the weight 15 form, together with the strands 6′ and 6″ of the first web 6, a storage means which prevents sudden loads from being exerted on the web 6 possibly causing it to tear.

When the tension in the web 6 increases, the pull exerted on the guide roller 11 by the strands 6′ and 6″ of the web increases thereby causing the spring 13 to be elongated and the guide roller 11 to move in the direction of the guide rollers 10 and 12 such that the loop which is formed by strands 6′ and 6″ of the web 6 and represents a sort of storage element, is shortened. Intermittent loads on the web 6 are eliminated right from the start due to the pliant resiliency of the spring 13. This storage means is especially advantageous when a second web 16, which is unwound from roll 5, is connected to the first web 6.

When most of the first web 6 has already been removed from the roll 4 and roll 4 is nearing an end, the start 16′ of a second web 16 which unwinds from roll 5 must be connected with the first web 6 in order to ensure continuous operation. In the device in accordance with FIG. 1, a transfer element designed as a roller 17 is provided for this purpose and can be moved to and from the roller 8. The roller 17 is rotatably journaled on a carriage (not shown) for this purpose. The carriage is driven by a motor via pinions, the motor engaging the toothed racks (not shown) which extend along the guides of the carriage. The transfer roller 17 is shown in FIG. 1 in solid lines in its receiving position in which it is separated from roller 8. In this receiving position, the start 16′ of the second web 16 is stuck to the circumference of roller 17 by means of an adhesive strip 18 provided with adhesive on both sides. The adhesive strip must be cemented to the beginning of the second web with its width such that a cemented interface relationship is established between the part which is cemented to the beginning of the web and the part which is cemented to the circumference of the roller 17. This ensures that the adhesive stip 18 which adheres to the beginning 16′ of the web 16 separates from the circumference of the roller 17 when the adhesive strip 18 is pressed onto the web 6 on the full surface on the side facing away from the web 16. When the start 16′ of the second web 16 has been cemented on the roller 17 and the start 16′ is supposed to be connected with the first web 6, the roller 17 is then moved in the direction of the web 6. When the roller 17 has reached the position indicated by the dotted line in FIG. 1, i.e. has been transported into its position of attachment, it comes into contact with the first web 6. The roller 8 serves as an abutment which permits the roller 17 to be pressed onto the web 6 under pressure. The roller 17 is set into rotary motor after it has contacted the web 6 and is accelerated to a circumferential speed corresponding to the speed of the web 6. This acceleration does not cause any sudden loads to be exerted on the second web 16 because an initial looped-shaped loose part has been previously removed from the roll 5 which is then taken up during acceleration. The adhesive strip 18 comes into contact with the web 6 and is pressed onto the same during the course of the rotation of the roller 17. During further rotation of the roller 17, the adhesive strip 18 is removed from the roller 17 due to the cemented interface relationship between the entire outer adhesive strip surface cemented to the first web and the inner adhesive strip surface adhering to the circumference of the roller 17. The start 16′ of the second web 16 is then stuck to the first web 6 by the adhesive strip 18 and is drawn along by the first web. This entire operation takes place very rapidly. The roller 17 is pressed on the roller 8 due to the action of the positive drive during this time. As soon as enough time has passed for the new web 16 to attach to the old web 6, the positive drive of the roller 17 is switched off, e.g. by means of a presure-sensitive switch and an adjustable time relay. In addition, a cutting device arranged in front of the roller 17 and having a reciprocal cutting blade 19 is activated. The cutting blade 19 then cuts the first web 6. The second web 16, which is connected with the part of the web 6 which is drawn upwardly, is then removed from the roll 5. The roller 17 can be returned to its receiving position. The new roll 5 must be accelerated at the very moment the second web 16 is picked up by the first web 6. In the case of the device illustrated in FIG. 1, this is accomplished exclusively by the tension caused by the web 16. This produces an increased pull load in the web 6 and the web 16 connected thereto until the roll 5 has been accelerated to its operational speed. However, a sudden load causing the web to tear cannot be produced because the guide roller 11 is moved in this phase due to the effect of the tension caused by the strands 6' and 6'' on the guide rollers 10 and 12 thereby causing the spring 13 to be stretched. When the tension exerted on the spring 13 becomes so great that it corresponds to the force of gravity exerted on the spring 13 by the weight 15, the weight 15 will then be lifted from a substrate 15A upon which it rested up to now. The tension present in the web remains constant during further movement of the web as long as the weight can be lifted upwardly. Only the web storage formed by the strands 6' and 6'' is shortened. As soon as the roll 5 has been accelerated to the necessary operational speed and the web 16 therefore unwinds from the roll 5 at the desired speed, the guide roller 11 and its carraige can then be moved away from the guide rollers 10 and 12 to the right in order to release the spring 13 and to increase the storage formed by the strands 6' and 6''. In so doing, the weight 15 is lowered again and rests on its substrate 15A anew. Brakes not shown in the drawing can be provided on the axes supporting the rolls 4 and 5. These brakes can decelerate the expended old web roll 4 and bring it to a standstill after the first web 6 has been cut or they can brake the new roll 5 until the tension desired for operation has been adjusted in the web 16.

The device according to FIG. 1 is designed such that the drum 8 is also arranged on a motor-driven carriage and can be reciprocally moved in a horizontal plane. In this manner, the drum 8 can serve as a transfer element by means of which a web unwinding from roll 4 can be applied to a web unwinding from roll 5 in case roll 5 is nearing an end. The application operation is in this case the same as the one described previously with regard to a connection of the start 16' of a second web 16 with a first unwinding web 6. In this case, however, the roles of drums 8 and 17 are reversed. The roller 17 would then be positioned as indicated by the dotted lines in FIG. 1 and serve as an abutment roller while the drum 8 would function as the transfer element. In order to separate the second web 16' from the roll 5, a cutting blade 20 is provided which can be activated in the same manner as the previously described cutting blade 19.

A second embodiment of a device for carrying out the process in accordance with the invention is schematically illustrated in FIG. 2. A double-armed support 22 is rotatably journaled on a frame 21. The support 22 has on each arm one support axis for a web roll 23 or 24. In the phase of operation shown in FIG. 2, the roll 24 is located in the position of attachment. A first web 25 unwinds from the roll 23 and is conducted over a roller 26 and guide rollers 27, 28 and 29 to further processing means which are not shown. The guide rollers 27 and 29 are rotatably journaled on stationary axes. The guide roller 28 is reciprocally journaled on a guide which is directed toward the rollers 27 and 29. The guide roller 28 is furthermore connected on each end with one spring 30 which is connected in turn with a weight 32 via a traction wire 31. The strands 25' and 25'' of the web 25 loop about the guide roller 28 and form a storage device together with said roller, the springs 30, the traction wires 31 and the weights 32. This storage device functions in the same manner as the storage device comprising parts 6', 6'', 11, 13, 14 and 15 of the device in accordance with FIG. 1.

The guide roller 26 is rotatably journaled at both ends on the front end of one respective pivotal lever 33. The pivotal lever 33 can be pivoted into an upper operational position shown in FIG. 2 and into a lower pressing position by means of a pneumatic cylinder piston unit 34. A transfer element designed as a transfer roller 35 is provided underneath the roller 26. This transfer roller 35 is rotatably journaled on a stationary axis. The roller 26 can be pressed against the circumference of the roller 35 by means of the pneumatic cylinder piston unit 34.

When the roll 23 approaches its end and a new web 36 is supposed to be connected to the old web 25, the start 36' of the new web 36 is cemented to the circumference of the transfer roller 35 by means of an adhesive strip 37 which has adhesive on both sides. The mode of function of the adhesive strip is the same as that of the adhesive strip 18 in the device in accordance with FIGS. 1 so that renewed explanation is not necessary. When the start 36' of the web 36 has been affixed to the transfer roller 35 and is supposed to be connected with the web 25, the roller 26 is pivoted downwardly by means of the piston cylinder unit 34 such that the web 25 is pressed against the roller 35 and is pushed through between the rollers 26 and 35 which are pressing against one another. The roller 35 is then rotated by frictional contact from the web 25 and is accelerated to a circumferential speed corresponding to the speed of the web 25. In this case as well, the web 36 will not be overloaded by the initial acceleration because a loose, loop-shaped region 36'' is initially tightened. During the rotational movement of the roller 35, the adhesive strip 37 comes into contact with the web 25 and is pressed thereto. During further movement of the web 25, the adhesive strip 27 is pulled off the transfer roller 35 while the start 36' of the web 36 is connected with the web 25. The web 36 is then pulled along by the web 25 in this manner.

After the connection has been established, the old web 25 is separated and cut by a cutting device 38 arranged in the region of the web and comprising a reciprocal cutting blade 39. The roller 26 is then removed from the transfer roller 35 by means of the pneumatic cylinder piston unit 34.

The new roll 24 must be accelerated to operational speed by the pull of the web 36. The storage means 28, 30, 31, 32 ensures that no inadmissible overloads become apparent in the web 36 during this process in the manner already explained in the description of the storage means of the device in accordance with FIG. 1. When the operational speed has been achieved, the support 22 is pivoted 180° counterclockwise. The roll 24 is thereby transported to the operational position while the roll 23 is conduced to the position for connection. The roll 24 can then be decelerated by a brake arranged on the axis supporting the same but not shown for reasons of clarity, such that a specific desired tension can be produced in the web 36. The roll 23 can be removed from its support axis and be replaced by a new replacement roll.

Both in the case of the device in accordance with FIG. 1 as well as in the case of the device in accordance with FIG. 2, the connection of the new web onto the old web and the change of rolls can take place without having to reduce the speed of the first unwinding web.

A third embodiment of a deivce in accordance with the invention is shown in FIGS. 3 to 5. The structure of this third embodiment agrees in principal with the structure of the device according to FIG. 2. Hence, those parts in FIGS. 3 to 5 which agree with the parts recited with reference to FIG. 2 are provided with the same reference numerals. A repeated discussion of these parts can be dispensed with. FIG. 3 shows a side elevation of half of a device. An analogously constructed second half of the device must be imagined on the right side of FIG. 3. The device in accordance with FIGS. 3 to 5 can therefore serve to conduct two webs to two further processing plants at th same time and to connect two new webs to two expiring webs concurrently. In so doing, the half of the device shown in FIG. 3 can serve to connect one new web to one old web. Accordingly, a new web can be connected to an old web in the half of the device which is not shown on the right-hand side. It is evident from FIGS. 3 to 5 that the guide roller 28 forming one part of the storage means of the device is journaled at both ends on one respective carriage 40. The two upper wheels 41 of each carriage 40 run on a rail 42. This structure can be seen in detail in FIGS. 6 and 7. The tooth construction 43 of the toothed rack is provided on the underside of each rail 42. The roller 28 carries at each end a pinion 44 which meshes with the respective tooth construction of the toothed rack 43. A geared motor 45 is mounted on one of the two carriages 40 serving to journal the ends of the guide roller 28. A freewheel clutch 46 is connected to the geared motor 45, which in turn bears a V-belt pulley 47. A V-belt pulley 48 is also mounted on the axis of the roller 28. The two V-belt pulleys 47 and 48 are coupled to one another via an endless V-belt which is not shown. The freewheel clutch 46 is designed such that the carriage 40 together with the roller 28 can be freely slid to the left to the rollers 27 and 29 from the position shown in FIG. 3 without coupling the motor 45. The carriage 40, however, can not slide in the opposite direction, i.e. toward the roller 26, without using the motor 45 which drives the axis of the roller 28 and hence the pinion 44 via the clutch 46. This construction ensures that rapid "emptying" of the loop storage formed by the strands 25' and 25'' of the web 25 is readily possible to prevent inadmissible overloads from forming in the web without the motor 45 hindering the rapid movement of the carriage 40. On the other hand, it is possible to increase the storage loop formed by the strands 25' and 25'' by means of the motor 45 after the operational tension in the web 25 has been reached by moving the carriage slowly to the right. This makes it possible to move the roller 28 to its outermost position at the right by means of the motor. The retractile force of the weight 32 and the sping 30 is thus supported by the motor in this manner.

As shown in FIG. 5, the traction wire 31, in the device according to FIGS. 3 to 5, is guided over two guide rollers 49 and 50 and along the guide rail 42 so that one respective spring 30 can be disposed along the respective guide rail 42 and connected to the wire 31 and, as a result, no additonal room is needed in the longitudinal direction for the spring.

The arrangement of a cutting device 38 underneath the guide rail 42 can be seen from FIGS. 3 and 6. The cutting device 38 is connected with a guide roller 51. The guide roller ensures that the web proceeds in correct orientation on the cutting device 38. FIG. 8 is an enlarged section through the cutting device 38. It can be seen in FIG. 8 that a cutting blade 39 is secured to a pivotable mounting 52 which can be pivoted in counterclockwise direction by means of an electrical solenoid 53. Return movement is carried out by a return spring 54. By actuating the electrical solenoid, it is possible to pivot the cutting blade 39 downwardly and cut the passing web. The cutting blade has already been pivoted into cutting position in FIG. 8 and has penetrated into the web 25 to be cut. The cutting blade has in its cutting region a number of adjacent triangular cutting teeth which are ground at the edges and which penetrate into the web 25 to be cut with their tips during downward pivoting of the cutting blade. The cutting movement of the cutting balde is also enhanced by further movement of the web 25 because the web 25 pulls the cutting teeth of the cutting blade along with it thereby pivoting the cutting blade downwardly to an even greater extent thus causing the blade teeth to penetrate even more deeply into the web until the web is completely separated by the blade teeth. A guard plate 55 is mounted in front of the cutting blade 39 on the cutting device 38. This guard plate is intended to prevent injuries to the operators.

The device shown in FIG. 3 makes it possible to secure the start of the new web 36 to the side facing roll 24 or with the side facing away from roll 24 on the old web 25 as desired. If the side of the web 36 facing roll 24 is supposed to be secured to the web 25, then roll 24 must be mounted on the support 22 such that the web 36 proceeds from the roll 24 in the manner shown by the solid lines at the right in FIG. 3 and must be secured on the roller 35. If the web 36 is supposed to be mounted with the outer side on the web 25, then the roll 24 must be disposed on the support 22 such that the web unwinds from the roll in the manner indicated by the dot-dash line in FIG. 3 and must be secured to the transfer roller 35.

Moreover, the device in accordance with FIGS. 3 to 8 functions in the manner recited for the device in accordance with FIG. 2 so that a repeated explanation is not necessary at this point.

A further embodiment of a device in accordance with the invention is shown in side elevation in FIG. 9. This embodiment concurs extensively with the embodiment in accordance with FIGS. 3 to 8. Concurring parts are designated by the same reference numerals.

In the case of the device in accordance with FIG. 9, a storage means is provided which is formed by strands 25' and 25'', the web 25, a guide roller 56, springs 30, traction wires 31 and weights 32. In this embodiment, the guide roller is provided at each end with a respective pinion 57 and abuts with these pinions on two toothed tracks 58 which extends parallel to one another. The toothed tracks 58 are mounted on longitudinal supports 59 and serve to longitudinally guide the roller 56 when this is moved transversely to its longitudinal axis by the tension of the web to compensate for these forces. During its movement, the roller 56 rolls on the toothed rack 58 by means of the pinions 57. The meshing of the pinions 57 in the toothed rack 58 ensures that the roller cannot run crooked or get stuck in the guide track. The roller 56 is not journaled in carriages in this embodiment which are motor driven, but are rather journaled directly on the guides. Springs 30 are attached to both ends of the roller 56 and tend to pull the roller 56 into the position shown at the right in FIG. 9 together with the weights 32. When greater tension is exerted on the web and particularly directly after a new web has been attached to the old web, the roller 56 is moved toward the left thus shortening the loop formed by the strands 25' and 25''. A middle position of the roller and its extreme left position are indicated in FIG. 9 by dotted lines. As soon as the tension in the web has returned to normal values in this device, the roller 56 is not returned to its initial position at the right by means of the motor, but is moved back into its normal position by the tension of the springs 30 in conjunction with the action of the weights 32.

As can be seen from FIG. 9, a stop 60 is provided at the upper end of the path of the weight 32, on the underside of which a compression spring 61 is disposed. When the tension in the web increases such that the force in the springs produced by the stretching of the same is as great as the force of gravity exerted by the weights 32, the weights 32 are then lifted and raised upwardly if this tension remains in the web. The tension in the web remains constant as long as the weights can be raised upwardly. If the weights reach the upper end of its path, a sudden load would be exerted on the web if the weights were to hit directly against the stops. By interposing the compression springs 61, it can be ensured that the force will again increase in a linear fashion and a sudden overload will be prevented. When the tension in the web decreases, the weights 32 fall downwardly again and finally abut once again on the base of the device.

A further embodiment of a device in accordance with the invention is shown in side elevation in FIG. 10. The structure of this device corresponds extensively with the principal structure described with the aid of FIG. 1 so that the parts of the device in accordance with FIG. 10 which agree with parts of the device in accordance with FIG. 1 are indicated by the same reference numerals. Another discussion of these features will not be entered into. In this embodiment, the rollers 8 and 17 which alternately function as transfer and abutment rollers are respectively journaled on carriages 62. One carriage is shown at one end of the roller 17 in FIG. 10. Corresponding carriages must be imagined at the other end of the roller 17 and at the ends of the roller 8. Each carriage 62 hangs on a guide rail 63 by two wheels. A toothed rack 64 is disposed on the underside of each guide rail 63. A pinion is journaled on each carriage 62 and engages the associated toothed rack 64. One motor is mounted on each roller 8 or 17 on a carriage 62. This motor drives the pinions of the carriages of the respective roller. The carriages 62 of each roller 8 or 17 and hence the respective roller itself can be driven toward the middle of the device by means of this motor. As soon as the rollers reach their final position in the middle of the device and press against one another, the respective driving motor is switched off by a pressure switch when a specific bearing pressure on the rollers have been achieved. A brake which is not shown is coupled in each case to the respective motor and makes it possible for the motor and hence the associated roller to be maintained in the respective set position. Each roller 8 or 17 can also be returned to its outer position away from the middle of the device by the motor as well. The cutting devices 19 and 20 are secured, together with the guide rollers 7, to a center frame which is mounted on the longitudinal rails 63.

The guide roller 11 of the storage device is journaled on carriages which can be driven along guide rails in this embodiment. One pinion is provided on both ends of the guide roller 11. This pinion engages a toothed rack which is arranged on the respective guide rail. The guide roller is in this way safeguarded against running obliquely and can be moved by the tension of the web and can be returned by the action of the tension spring and the counterweights.

The rolls 4 and 5, from which the web is unwound, are disposed on stationary supports in this embodiment. A web 6 which unwinds from the roll 4 can be connected to a new web 16 unwinding from roll 5 or vice-versa, a web 16 unrolling from roll 5 can be alternately attached to a new web coming from roll 4. The one roller 8 then functions alternately as an abutment roller and must be maintained in its inner position while the roller 17 serves as the transfer roller in alternate fashion or roller 17 functions as the abutment roller and is maintained in its inner position while roller 8 serves as the transfer roller.

It is also possible in this embodiment to alternately connect the new web with the side facing the roll or with the side facing away from the roll with the old web. According to which side is to be connected, the new roll must be journaled on the support axis of the frame of the device in the one or other direction.

This invention is not restricted to the examples described above. For example, it is possible to provide an endless recirculating web or webs instead of the transfer rollers. It is also possible, for example, not to accomplish the reciprocal movement of the transfer or abutment rollers 8 or 17 by means of motors and toothed rack drives as in the embodiment in accordance with FIG. 10, but to perform this by means of pneumatic or hydraulic cylinder piston units.

The apparatus in accordance with the invention can, for example, be carried out such that not a two-sided adhesive strip is cemented to the start of the new web, but rather that both sides of the start of the new web are provided with an adhesive coating, for example, an adhesive with a latex base. In so doing, however, attention must be paid to the fact that the adhesive relationship between the adhesive area of the new web to be cemented to the transfer element and the adhesive area of the new web to be cemented to the old web subsequently is selected such that the new web will be pulled off the transfer element with certainty when the old web proceeds in its movement, after it has once been cemented to the old web, and that it will be pulled along by the old web. The connecting operation can furthermore also be carried out by using a two-sided adhesive coating in the devices described above.

The storage means 1, 13, 14, 15 and 28, 30, 31, 32 can be designed such that they resist the tension proceeding from the web at least initially by a progressive resistance. A characteristic of the storage resistance which initially progresses flatly, then increases progressively and finally proceeds linearly or degressively as desired is especially expedient. This makes it possible to gently accelerate the new web in the case of a small storage means. Spring characteristics of this type can be attained by suitable mechanical springs. In place of the shown spring-weight-storage means, however, hydraulic, pneumatic or electrical means can also be employed, for instance motors with corresponding braking characteristics.

Web as used in the above description is meant to mean a paper band.

The embodiments of the invention in which an exclusive property or privilege is claimed are defined as follows:

1. In a device for connecting a first web of a web-shaped material unwinding from a first roll to the beginning of a second web of a web-shaped material unwinding from a second roll and having at least one transfer element and releasable engaging means for releasably coupling said second web to said transfer element, said transfer element effecting a pressing of said beginning of said second web to said first web, an adhesive for connecting said first web to said beginning of said second web, and a cutting device for cutting the first web downstream of a point where said second web is attached to said first web, the improvement comprising a guide roller for guiding said first web thereover, first support means for supporting said guide roller for movement along a path generally parallel with an exiting strand of said first web therefrom, resilient means, one end of which is connected to said guide roller, for biasing said guide roller to a first position, weight means, second support means for supporting said weight means, cable means extending between said weight means and the other end of said resilient means, third support means for supporting said cable means to effect a vertical movement of said weight means from off said second support means when the tension force applied by said first web to said guide roller exceeds the return force of said resilient means and the weight of said weight means, the return force of said resilient means increasing as said guide roller is moved along said path away from said first position in response to an increased tension force being applied to said first web, the magnitude of said weiight means and said return force of said resilient means being greater than a normal tension force of said first web on said guide roller during normal operation thereof to thereby effect a holding of said guide roller at said first position.

2. An apparatus according to claim 1, wherein said first support means includes a guide element which is movable toward said transfer element into a pressing position to transfer the first web and away from the transfer element to a position remote therefrom.

3. An apparatus according to claim 2, further including a pneumatic or hydraulic cylinder piston unit for moving the guide element into said position remote from the transfer element and into said pressing position to contact the transfer element.

4. An apparatus according to claim 1, wherein the transfer element further includes a carriage, a driving system therefor and a guide for said carriage, said carriage being movable by said driving system along said guide between a receiving position remote from said first web and a pressing position.

5. An apparatus according to claim 4, wherein said carriage includes supporting wheels; and wherein the guide is a rail guide upon which the carriage is supported by means of said wheels, said driving system including a drive motor, said carriage having said drive motor thereon for effecting a driving movement of said carriage.

6. An apparatus according to claim 5, wherein said rail guide includes two toothed racks extending parallel to said rail guide and wherein said drive system further includes two pinions drivien by said drive motor, each one of said two pinions engaging one respective toothed rack to prevent the carriage from becoming stuck.

7. An apparatus according to claim 1, wherein an abutting device is provided for receiving the bearing pressure exerted by the transfer element when engaging and pressing against the first web.

8. An apparatus according to claim 7, wherein the abutting device is a rotary roller.

9. An apparatus according to claim 1, wherein said cutting device includes a cutting blade and a support therefor supporting said cutting blade for movement into a non-operative position remote from the first web and into a cutting position for cutting the first web.

10. An apparatus according to claim 9, wherein said cutting device includes a solenoid wherein said cutting blade is reciprocally movable by said solenoid and wherein a guide roller for the web to be cut is provided in front of the cutting device.

11. An apparatus according to claim 1, further including a stop at the upper limit of travel of said weight means for restricting the movement of said weight means when lifted due to the traction of the web and a buffer spring device disposed between the stop and the weight means.

12. An apparatus according to claim 1, wherein said first support means includes guide rails, wherein the guide roller is movably conducted on said guide rails in a direction extending transverse to the axis thereof.

13. An apparatus according to claim 12, wherein at least two parallel toothed racks define said guide rails, on which the guide roller is movably supported.

14. An apparatus according to claim 13, wherein said first support means further includes a carriage and two driven pinions, said carriage having said guide roller mounted thereon, said carriage being movably mounted on said guide rails with said at least two driven pinions engaging said toothed racks extending along the path of movement of the guide roller.

15. An apparatus according to claim 14, further including a drive motor mounted on said carriage, said drive motor driving at least one of said pinions engaging one of the toothed racks, a freewheel coupling interposed between said drive motor and said one pinion to permit movement of the carriage and the guide roller in the direction in which the return force of the resilient means increases.

16. An apparatus according to claim 1, including a support device having two support axes, for said two web rolls, said support axes being pivotal and secured in position independently of one another and further including an additional transfer element, and wherein above said support device between the web rolls both of said transfer elements are provided which are movable and positionable relative to one another and which are both abutment devices.

17. An apparatus according to claim 1, including a support device having a two-armed support pivotable about a middle axis, which has a support axis for a web roll on each arm, the support being pivotable through a 180° angle during each change of rolls in order to transport the new web roll from a connecting position into an operational position and wherein the transfer element is disposed laterally above the connecting position.

18. A device according to claim 1, wherein said transfer element is a rotatable roller.

19. A device according to claim 1, including means for supporting said transfer element for movement between a receiving position and a pressing position, said transfer element in said pressing position effecting a contact between said first and second webs.

20. A device according to claim 1, including guide means engaging said first web and for moving said first web between a starting position and a pressing position, said first web in said pressing position effecting a contact between said first and second webs.

* * * * *